US007226051B2

(12) United States Patent
Sawai

(10) Patent No.: US 7,226,051 B2
(45) Date of Patent: Jun. 5, 2007

(54) SHEET FEEDER

(75) Inventor: Kunio Sawai, Osaka (JP)

(73) Assignee: Funai Electric Co., Ltd., Daito-shi (JP)

( * ) Notice: Subject to any disclaimer, the term of this patent is extended or adjusted under 35 U.S.C. 154(b) by 358 days.

(21) Appl. No.: 10/840,380

(22) Filed: May 7, 2004

(65) Prior Publication Data

US 2004/0256795 A1 Dec. 23, 2004

(30) Foreign Application Priority Data

May 9, 2003 (JP) ..... 2003-132030

(51) Int. Cl.
*B65H 5/02* (2006.01)

(52) U.S. Cl. ..... 271/272; 271/314; 384/276; 384/418; 384/444; 384/129

(58) Field of Classification Search ..... 271/272, 271/314; 384/276, 418, 444, 129
See application file for complete search history.

(56) References Cited

U.S. PATENT DOCUMENTS 6,769,683 B2 * 8/2004 Hiramatsu ..... 271/274
2002/0067941 A1 * 6/2002 Johnson et al. ..... 400/352
2004/0017461 A1 * 1/2004 Saito ..... 347/104

FOREIGN PATENT DOCUMENTS

| | | |
|---|---|---|
| JP | 61-197349 | 9/1986 |
| JP | 6-64981 | 9/1994 |
| JP | 10-139235 | 5/1998 |

* cited by examiner

*Primary Examiner*—David H. Bollinger
(74) *Attorney, Agent, or Firm*—Crowell & Moring LLP

(57) ABSTRACT

In a sheet feeder of the present invention, a groove-shaped concave provided on an inner surface of a bearing extends therethrough in a direction where a rotational shaft of a feed roller extends. A surface of the rotational shaft of the feed roller is supported on a pair of outer edges of the groove-shaped concave formed on the inner surface of the bearing. A bottom of the groove-shaped concave is substantially circular-arc and concentric with the inner surface of the bearing other than the groove-shaped concave. The bottom of the groove-shaped concave is formed at such a depth that the surface of the rotational shaft of the feed roller does not contact the bottom while the rotational shaft of the feed roller is supported on the outer edges of the groove-shaped concave.

6 Claims, 4 Drawing Sheets

SHEET FEEDER

BACKGROUND OF THE INVENTION

1. Field of the Invention

This invention relates to a sheet feeder, and more particularly to a sheet feeder including a feed roller for feeding paper.

2. Description of the Related Art

Currently, there are various types of known sheet feeders equipped with feeding rollers for feeding sheets of paper (for example, see JP-A-61-197349, JP-UM-A-6-64981 and JP-A-10-139235).

JP-A-61-197349 discloses a sheet feeder in which hindrance of paper feeding caused by the tip of curled paper impinging on a pair of paper feeding rollers is avoided by means of an auxiliary ring which smoothly introduces the tip of paper into the contacting portion between the feeding rollers.

JP-UM-A-6-64981 shows another sheet feeder in which backlash by a feed roller against a drive shaft during rotation is eliminated by bringing substantially D-shaped mating holes in fixing members attached to both sides of the feed roller into engagement with the drive shaft having a corresponding D-shaped cross-section.

JP-A-10-139235 describes still another sheet feeder in which the number of components is reduced by forming an acute-angled elastic rib for pressing a discharge roller against a feed roller to be integral with the discharge roller, as compared with a sheet feeder which includes a separate member for pressing the discharge roller.

FIG. 7 is a front view illustrating a conventional sheet feeder including a feed roller as an example. FIG. 8 is a cross-sectional view of the sheet feeder taken along a line 150—150 in FIG. 7. FIG. 9 is another cross-sectional view showing the sheet feeder taken along a line 160—160 in FIG. 7. Referring to the structure of the conventional sheet feeder in FIG. 7, the sheet feeder contains a feed roller 101 for feeding sheets of paper 200. The feed roller 101 has a rotational shaft 101*a*. The rotational shaft 101*a* of the feed roller 101 is inserted into bearings 102 provided adjacent to both ends of the rotational shaft 101*a* leaving a predetermined width of play between the bearings 102 and the rotational shaft 101*a*. As illustrated in FIG. 8, each of the bearings 102 has a circular inner surface 102*a* having an inside diameter larger than the diameter of the rotational shaft 101*a* of the feed roller 101. The rotational shaft 101*a* of the feed roller 101 is rotationally supported on the bearings 102 in such a manner that the surface of the rotational shaft 101*a* is held on the inner surfaces 102*a* of the bearings 102.

A gear (not shown) for transmitting driving force from a drive motor (not shown) is equipped at one end of the rotational shaft 101*a* of the feed roller 101. As illustrated in FIG. 7, pinch rollers 103 are provided for pressing the paper 200 against the feed roller 101. The pinch rollers 103 are attached to a rotational shaft 103*a*. The rotational shaft 103*a* of the pinch rollers 103 is rotationally supported by a holder 104. The holder 104 presses the pinch rollers 103 against the feed roller 101 by means of a spring (not shown).

An operation of the related-art sheet feeder as shown in FIG. 7 is now described referring to FIGS. 8 and 9. In operation of the sheet feeder in FIG. 7, the feed roller 101 is rotated in a direction shown by an arrow A in FIG. 9 by the driving force transmitted from the drive motor (not shown) through the gear (not shown) to the rotational shaft 101*a* of the feed roller 101. During rotation of the feed roller

101, the rotational shaft 101*a* of the feed roller 101 is rotated while contacting the inner surface 102*a* of the bearing 102 at a contacting point P which is inclined from the lowermost position through an angle of θ1 as illustrated in FIG. 8. The pinch rollers 103 are then rotated in a direction of an arrow B in FIG. 9 along with the rotation of the feed roller 101. Thus, the paper 200 inserted between the feed roller 101 and the pinch rollers 103 is conveyed in a direction of an arrow C in FIG. 9. At this stage, the paper 200 applies a load W to the feed roller 101 in a direction opposite to the moving direction of the paper 200 (i.e., the direction of the arrow C in FIG. 9).

According to the conventional sheet feeder shown in FIG. 7, however, a problem has been arising that the position of the contact point P between the rotational shaft 101*a* of the feed roller 101 and the inner surface 102*a* of the bearing 102 varies due to fluctuation in the load W (shown in FIG. 8) applied to the feed roller 101 from the paper 200. More specifically, the contact point P moves in such a direction that the angle θ1 becomes smaller when the load W is larger, while the contact point P moves in such a direction that the angle θ1 becomes larger when the load W is smaller. Thus, positional variation of the feed roller 101 is caused in a direction parallel to the feeding direction of the paper 200 (i.e., the direction of the arrow C in FIG. 9), which changes the feeding volume of the paper 200 by the operation of the feed roller 101. Accordingly, the sheet feeder of FIG. 7 has a drawback that the accurate control of the feeding volume of paper is difficult.

Similarly, in the sheet feeders disclosed in JP-A-61-197349, JP-UM-A-6-64981 and JP-A-10-139235, it is difficult to accurately control the feeding volume of paper as in the sheet feeder shown in FIG. 7 since no measure is taken for preventing the rotational shaft of the feed roller from shifting with respect to the bearings.

SUMMARY OF THE INVENTION

For solving the above problem, an object of the present invention is to provide a sheet feeder capable of accurately controlling the feeding volume of paper.

In order to achieve the above object, a sheet feeder according to a first aspect of the present invention includes a feed roller for rotating around a rotational shaft and for feeding paper, a bearing through which the feed roller is inserted leaving a predetermined width of play between the rotational shaft and the bearing for rotationally supporting the rotational shaft of the feed roller, and a pinch roller for pressing the paper against the feed roller. A groove-shaped concave provided on an inner surface of the bearing extends therethrough in a direction where the rotational shaft of the feed roller extends. A surface of the rotational shaft of the feed roller is supported on a pair of outer edges of the groove-shaped concave formed on the inner surface of the bearing. A bottom of the groove-shaped concave is substantially circular-arc and concentric with a circular inner surface of the bearing other than the concave, and is formed at such a depth that the surface of the rotational shaft does not contact the bottom while the rotational shaft of the feed roller is supported on the two outer edges of the groove-shaped concave.

In the sheet feeder according to the first aspect of the invention as described, the surface of the rotational shaft of the feed roller supported on the two outer edges of the groove-shaped concave of the bearing shifts less easily along the inner surface of the bearing than the surface of the rotational shaft supported on a single supporting point. Thus, even when the load W applied from the paper during paper feeding by the feed roller is varied, movement of the rotational shaft of the feed roller along the inner surface of the bearing, i.e., positional variation of the feed roller in a direction parallel to the moving direction of the paper, is prevented. Since changes in the feeding volume of the paper due to the positional variation of the feed roller are thus eliminated, the feeding volume of the paper can be accurately controlled. Moreover, the bottom of the groove-shaped concave of the bearing is formed at such a depth that the surface of the rotational shaft of the feed roller does not contact the bottom while the rotational shaft of the feed roller is supported on the two outer edges of the groove-shaped concave as described above. Since the surface of the rotational shaft does not contact the bottom of the groove-shaped concave, the two outer edges can easily support the surface of the rotational shaft. Furthermore, since the bottom of the groove-shaped concave of the bearing is substantially circular-arc and concentric with the circular inner surface of the bearing other than the groove-shaped concave, contact between the surface of the rotational shaft of the feed roller and the bottom of the groove-shaped concave is easily avoided and the bearing capable of supporting the rotational shaft by two supporting points can be easily manufactured.

A sheet feeder according to a second aspect of the present invention includes a feed roller for rotating a round a rotational shaft and for feeding paper, and a bearing for rotationally supporting the rotational shaft of the feed roller. The bearing includes a groove-shaped concave which is formed on an inner surface of the bearing and has a pair of outer edges for supporting a surface of the rotational shaft of the feed roller.

In the sheet feeder according to the second aspect of the invention as described, the surface of the rotational shaft of the feed roller supported on the two outer edges of the groove-shaped concave of the bearing shifts less easily along the inner surface of the bearing than the surface of the rotational shaft supported on a single supporting point. Thus, even when the load W applied from the paper during paper feeding by the feed roller is varied, movement of the rotational shaft of the feed roller along the inner surface of the bearing, i.e., positional variation of the feed roller in a direction parallel to the moving direction of the paper, is prevented. Since changes in the feeding volume of the paper due to positional variation of the feed roller are thus eliminated, the feeding volume of the paper can be accurately controlled.

In the sheet feeder according to the second aspect of the invention as described above, the bottom of the groove-shaped concave of the bearing is preferably formed at such a depth that the surface of the rotational shaft of the feed roller does not contact the bottom while the rotational shaft of the feed roller is supported on the two outer edges of the groove-shaped concave. Since the surface of the rotational shaft does not contact the bottom of the groove-shaped concave, the outer edges of the groove-shaped concave can easily support the surface of the rotational shaft.

In the sheet feeder according to the second aspect of the invention as described, the bottom of the groove-shaped concave of the bearing is preferably substantially circular-arc and concentric with a circular inner surface of the bearing other than the groove-shaped concave. This structure easily prevents contact between the surface of the rotational shaft of the feed roller and the bottom of the groove-shaped concave of the bearing, and the bearing capable of supporting the rotational shaft by two supporting points can be easily manufactured.

In the sheet feeder according to the second aspect of the invention as described above, the bottom of the groove-shaped concave of the bearing is preferably formed flat. This configuration allows the groove-shaped concave of the bearing to be easily processed or formed, and the bearing with the concave capable of supporting the rotational shaft of the feed roller by two supporting points can be easily manufactured.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Hereinafter described are embodiments according to the present invention in conjunction with the annexed drawings.

First Embodiment

Figure 1:
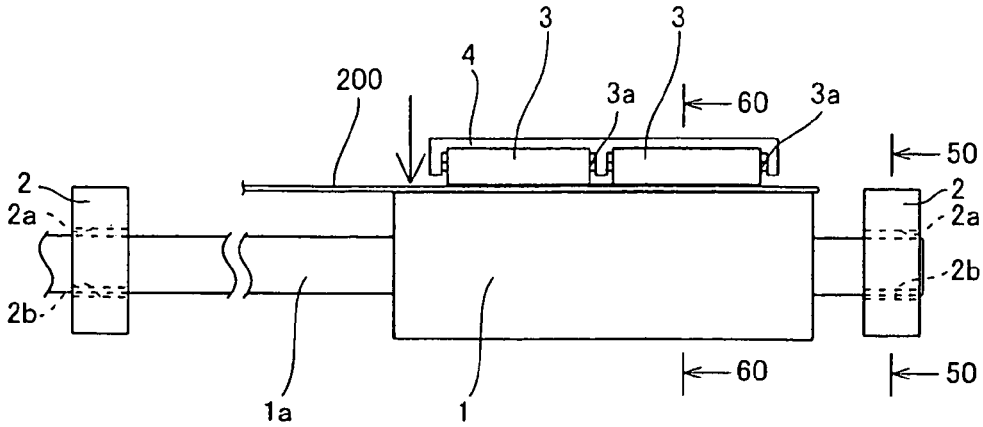
FIG. 1 is a front view showing a structure of a sheet feeder of a first embodiment according to the present invention.
Figure 2:
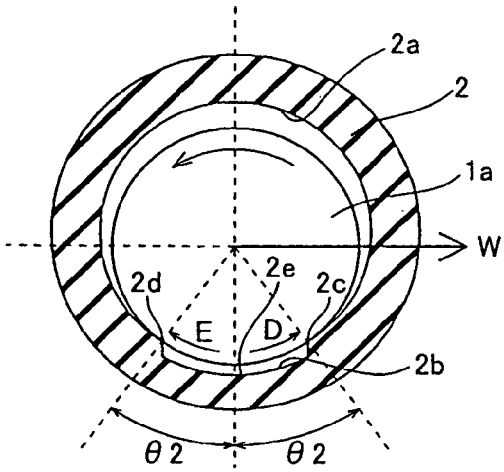
FIG. 2 is a cross-sectional view showing the sheet feeder of the first embodiment in FIG. 1 taken along a line 50—50.
Figure 3:
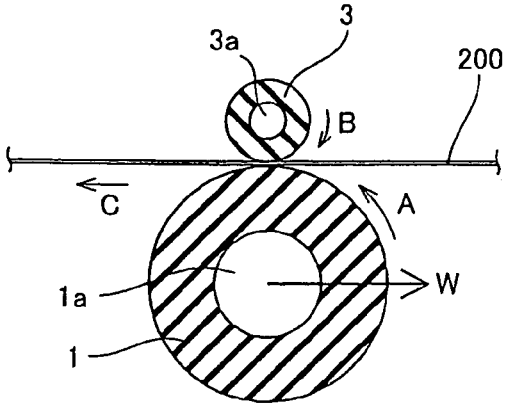
FIG. 3 is a cross-sectional view showing the sheet feeder of the first embodiment in FIG. 1 taken along a line 60—60.

FIG. 1 is a front view illustrating the structure of a sheet feeder as a first embodiment according to the present invention. FIG. 2 is a cross-sectional view showing the sheet feeder of the first embodiment in FIG. 1 taken along a line 50—50. FIG. 3 is another cross-sectional view showing the sheet feeder of the first embodiment in FIG. 1 taken along a line 60—60. The structure of the sheet feeder of the first embodiment according to the invention is first described with reference to FIGS. 1 and 2. As illustrated in FIG. 1, the sheet feeder of this embodiment includes a feed roller 1 made from rubber for feeding the paper 200. The feed roller 1 has a rotational shaft 1*a* formed from metal. The rotational shaft 1*a* of the feed roller 1 is inserted into bearings 2 provided adjacent to both ends of the rotational shaft 1*a* leaving a predetermined width of play between the bearings 2 and the rotational shaft 1*a*. The bearings 2 are molded from resin or other material using a die. Each of the bearings 2 has a circular inner surface 2*a* having an inside diameter approximately 0.1 mm larger than the diameter of the rotational shaft 1*a* of the feed roller 1 as illustrated in FIG. 2.

In the first embodiment, a groove-shaped concave 2*b* provided at the lower position of the inner surface 2*a* of the bearing 2 extends through the inner surface 2*a* of the bearing 2 along a direction in which the rotational shaft 1*a* of the feed roller 1 extends as illustrated in FIG. 2. The surface of the rotational shaft 1*a* of the feed roller 1 is supported on a pair of outer edges 2*c* and 2*d* of the groove-shaped concave 2*b*. By this arrangement, the rotational shaft 1*a* of the feed roller 1 is rotationally supported on the bearing 2. The pair of the outer edges 2*c* and 2*d* are formed at respective locations inclined through an angle of θ2 (θ2=approximately from 10 degrees to approximately 45 degrees) from the lowermost position.

A bottom 2*e* of the groove-shaped concave 2*b* is located at such a depth that the surface of the rotational shaft 1*a* of the feed roller 1 does not contact the bottom 2*e* while the rotational shaft 1*a* of the feed roller 1 is supported on the outer edges 2*c* and 2*d* of the concave 2*b*. Since the surface of the rotational shaft 1*a* of the feed roller 1 does not contact the bottom 2*e* of the groove-shaped concave 2*b* of the bearing 2, frictional force is not caused between the surface of the rotational shaft 1*a* and the bottom 2*e* of the concave 2*b*.

The bottom 2*e* of the groove-shaped concave 2*b* is substantially circular-arc and concentric with the circular inner surface 2*a* of the bearing 2 other than the groove-shaped concave 2*b*.

A gear (not shown) for transmitting driving force from a drive motor (not shown) is provided at one end of the rotational shaft 1*a* of the feed roller 1. As illustrated in FIG. 1, pinch rollers 3 made of resin or other material for pressing the paper 200 against the feed roller 1 are equipped above the feed roller 1. The pinch rollers 3 are attached to a metal rotational shaft 3*a*. The rotational shaft 3*a* of the pinch rollers 3 is rotationally supported by a holder 4 formed from resin. The holder 4 presses the pinch rollers 3 against the feed roller 1 by means of a spring (not shown).

The operation of the sheet feeder of the first embodiment is now described with reference to FIGS. 2 and 3. Referring first to FIG. 3, the feed roller 1 is rotated in a direction shown by an arrow A in FIG. 3 by the driving force transmitted from the drive motor (not shown) through the gear (not shown) to the rotational shaft 1*a* of the feed roller 1. Along with the rotation of the feed roller 1, the pinch rollers 3 pressed by the feed roller 1 is rotated in a direction shown by an arrow B in FIG. 3. Thus, the paper 200 inserted between the feed roller 1 and the pinch rollers 3 is conveyed in a direction of an arrow C in FIG. 3. At this stage, the paper 200 applies a load W to the feed roller 1 in a direction opposite to the moving direction of the paper 200 (i.e., the direction of the arrow C in FIG. 3).

Since the surface of the rotational shaft 1*a* of the feed roller 1 is supported on the pair of the outer edges 2*c* and 2*d* of the groove-shaped concave 2*b* of the bearing 2, the rotational shaft 1*a* of the feed roller 1 does not contact the bottom 2*e* of the groove-shaped concave 2*b* during rotation of the rotational shaft 1*a* as illustrated in FIG. 2. As a result, the rotational shaft 1*a* of the feed roller 1 does not easily shift along the inner surface 2*a* of the bearing 2, and the movement of the rotational shaft 1*a* along the inner surface 2*a* is thus prevented even when the load W is varied. More specifically, shifting of the rotational shaft 1*a* of the feed roller 1 along the inner surface 2*a* of the bearing 2 in a direction shown by an arrow D in FIG. 2 due to increase in the load W is prevented by the outer edge 2*c* of the groove-shaped concave 2*b*. Reversely, shifting of the rotational shaft 1*a* along the inner surface 2*a* in a direction shown by an arrow E in FIG. 2 is prevented by the other outer edge 2*d* of the concave 2*b*.

As described above, the surface of the rotational shaft 1*a* of the feed roller 1 supported on the pair of the outer edges 2*c* and 2*d* of the groove-shaped concave 2*b* of the bearing 2 shifts less easily along the inner surface 2*a* of the bearing 2 than the surface of the rotational shaft 1*a* supported on a single supporting point. Thus, even when the load W applied to the feed roller 1 from the paper 200 during paper feeding by the feed roller 1 is varied, movement of the rotational shaft 1*a* of the feed roller 1 along the inner surface 2*a* of the bearing 2, i.e., positional variation of the feed roller 1 in a direction parallel to the moving direction of the paper 200, is prevented. Since changes in the feeding volume of the paper 200 due to the positional variation of the feed roller 1 are thus eliminated, the feeding volume of the paper 200 can be accurately controlled.

As described above, the bottom 2*e* of the groove-shaped concave 2*b* of the bearing 2 is formed at such a depth that the surface of the rotational shaft 1*a* of the feed roller 1 does not contact the bottom 2*e* while the rotational shaft 1*a* of the feed roller 1 is supported on the two outer edges 2*c* and 2*d* of the groove-shaped concave 2*b*. Since the surface of the rotational shaft 1*a* does not contact the bottom 2*e* of the groove-shaped concave 2*b*, the outer edges 2*c* and 2*d* of the groove-shaped concave 2*b* can easily support the surface of the rotational shaft 1*a*.

Additionally, since the bottom 2*e* of the groove-shaped concave 2*b* of the bearing 2 is substantially circular-arc and concentric with the circular inner surface 2*a* of the bearing 2 other than the groove-shaped concave 2*b*, contact between the surface of the rotational shaft 1*a* of the feed roller 1 and the bottom 2*e* of the groove-shaped concave 2*b* is easily avoided and the bearing 2 capable of supporting the rotational shaft 1*a* by two supporting points can be easily manufactured.

Figure 4:
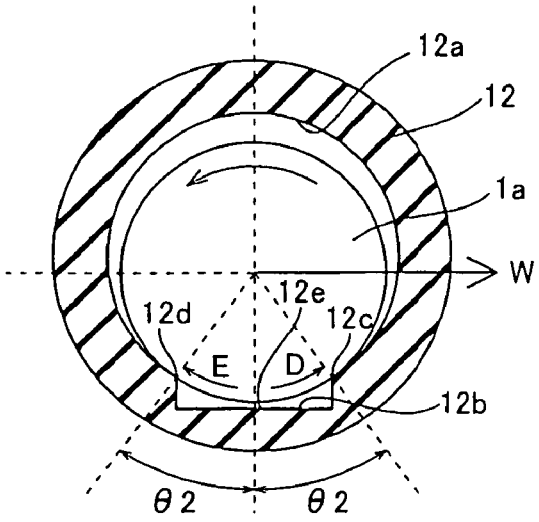
FIG. 4 is a cross-sectional view showing a modified sheet feeder of the first embodiment according to the present invention corresponding to the sheet feeder in FIG. 2.

Described next is a modified sheet feeder of the first embodiment according to the present invention. FIG. 4 is a cross-sectional view showing the modified sheet feeder of the first embodiment corresponding to FIG. 2. Different from the sheet feeder shown in FIG. 2, the modified example of the sheet feeder as illustrated in FIG. 4 has a flat bottom 12*e* of a groove-shaped concave 12*b* provided at the lower portion of an inner surface 12*a* of a bearing 12. The structure and the operation of the modified sheet feeder other than the above-described different point are the same as those of the sheet feeder according to the first embodiment.

More specifically, in the modified example of this embodiment, the rotational shaft 1*a* of the feed roller 1 is rotationally supported on a pair of outer edges 12*c* and 12*d* of the groove-shaped concave 12*b*. The bottom 12*e* of the groove-shaped concave 12*b* is flat and formed at such a depth that the surface of the rotational shaft 1*a* of the feed roller 1 does not contact the bottom 12*e*.

As described above, since the bottom 12*e* of the groove-shaped concave 12*b* of the bearing 12 is formed flat, the groove-shaped concave 12*b* of the bearing 12 can be easily processed or formed. Accordingly, the bearing 12 capable of supporting the rotational shaft 1*a* of the feed roller 1 by two supporting points can be easily manufactured.

Second Embodiment

Figure 5:
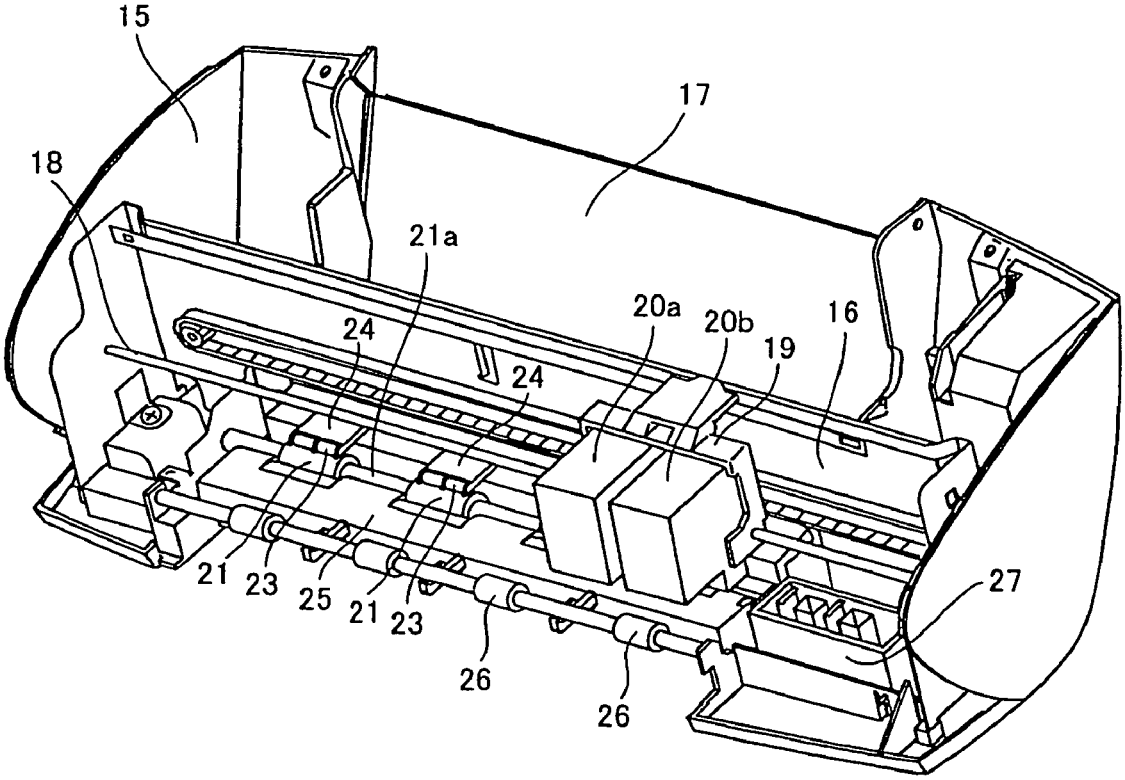
FIG. 5 is a perspective view illustrating an entire structure of an ink jet printer including a sheet feeder of a second embodiment according to the preset invention.
Figure 6:
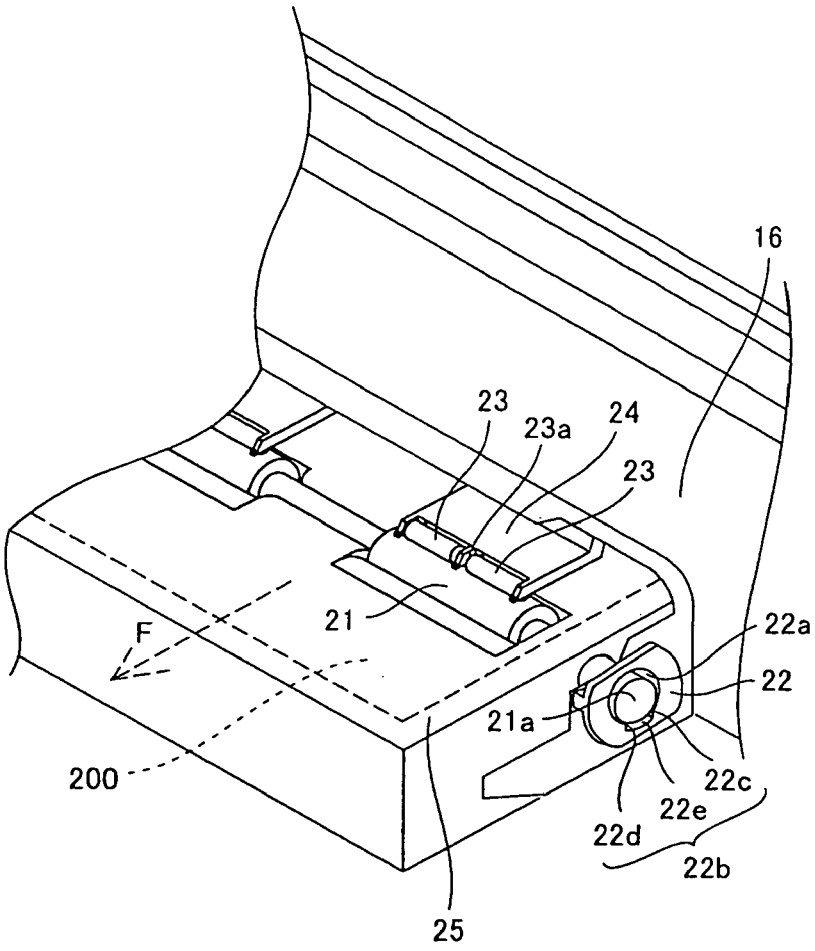
FIG. 6 is a perspective enlarged view illustrating a sheet feeder area of the ink jet printer of the second embodiment in FIG. 5.
Figure 7:
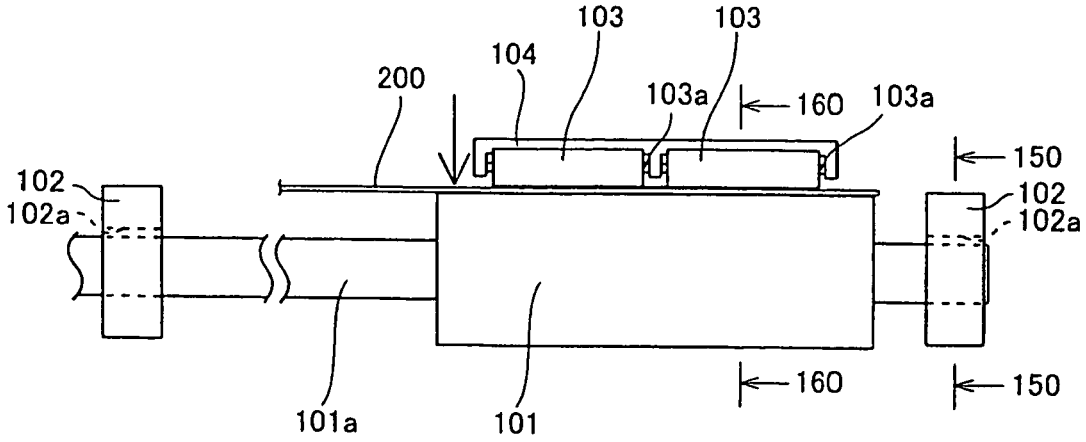
FIG. 7 is a front view showing a structure of a related-art sheet feeder including a feed roller for feeding paper.
Figure 8:
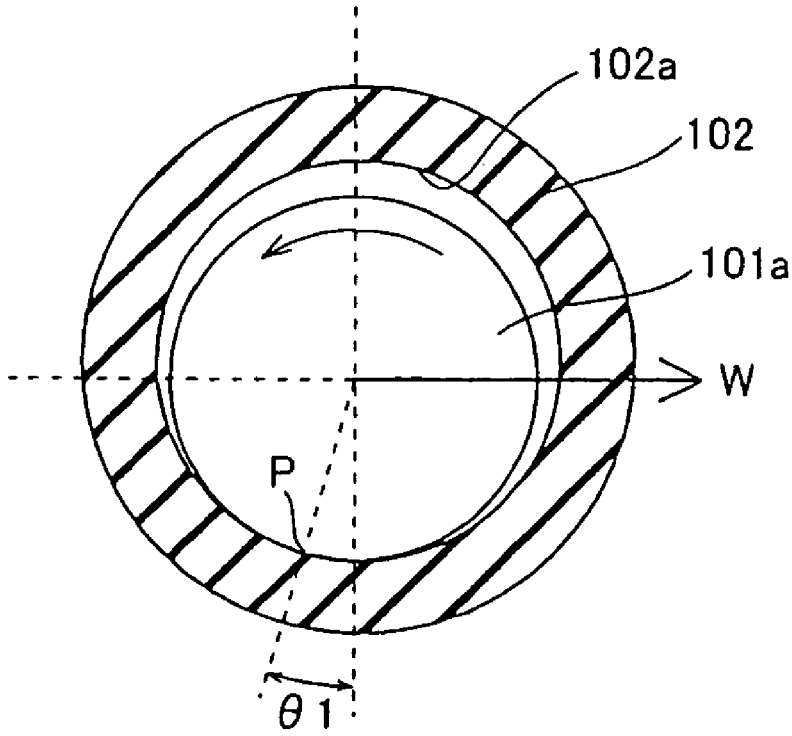
FIG. 8 is a cross-sectional view showing the related-art sheet feeder in FIG. 7 taken along a line 150—150.
Figure 9:
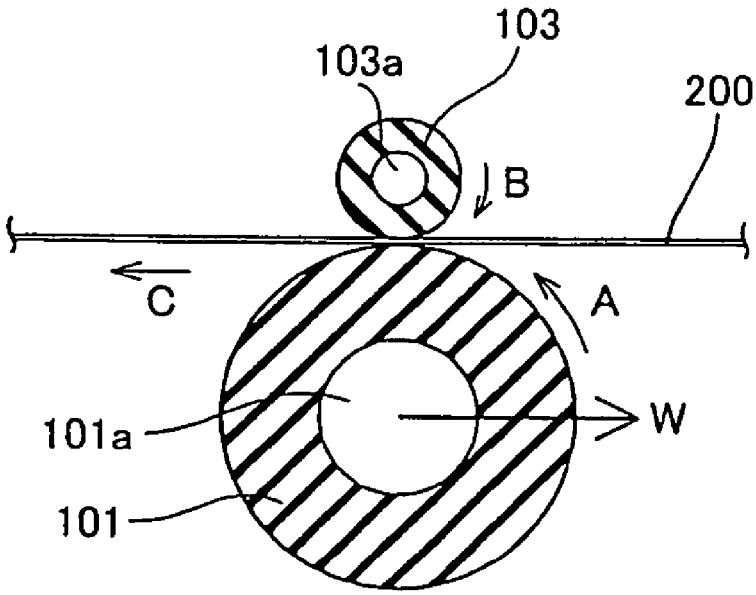
FIG. 9 is a cross-sectional view showing the related-art sheet feeder in FIG. 7 taken along a line 160—160.

FIG. 5 is a perspective view illustrating the entire structure of an ink jet printer including a sheet feeder of a second embodiment according to the present invention. FIG. 6 is an enlarged perspective view showing a sheet feeder area of the ink jet printer of the second embodiment in FIG. 5. In the second embodiment, an example in which the sheet feeder of the described first embodiment is applied to an ink jet printer is described with reference to FIGS. 5 and 6.

In the structure of the ink jet printer of the second embodiment, there is equipped a metal chassis 16 on a resin base cover 15 as illustrated in FIG. 5. A sheet feeding tray 17 on which the paper 200 is placed (shown in FIG. 6) is provided outside the chassis 16. The chassis 16 has a metal shaft 18. An ink carrier 19 movable in the lateral direction is attached to the shaft 18. A color ink cartridge 20*a* and a black-and-white ink cartridge 20*b* are both fitted to the ink carrier 19. An ink nozzle (not shown) used for printing is provided on each bottom of the ink cartridges 20*a* and 20*b*.

As illustrated in FIGS. 5 and 6, feed rollers 21 made of rubber for conveying the paper 200 are equipped below the ink cartridges 20*a* and 20*b* at the center of the lower region of the chassis 16. The feed rollers 21 are attached to a metal rotational shaft 21*a*. As illustrated in FIG. 6, one end of the rotational shaft 21*a* of the feed rollers 21 is inserted into a bearing 22 secured to the chassis 16 leaving a predetermined width of play between the rotational shaft 21*a* and the bearing 22. The bearing 22 is molded from resin using a die. The bearing 22 has a circular inner surface 22*a* having an inside diameter larger than the diameter of the rotational shaft 21*a* of the feed rollers 21.

A groove-shaped concave 22*b* provided at the lower position of the inner surface 22*a* of the bearing 22 extends through the inner surface 22*a* of the bearing 22 along a direction in which the rotational shaft 21*a* of the feed rollers 21 extends. The surface of the rotational shaft 21*a* of the feed rollers 21 is supported on a pair of outer edges 22*c* and 22*d* of the groove-shaped concave 22*b*. By this arrangement, the rotational shaft 21*a* of the feed roller 21 is rotationally supported by the bearing 22. The pair of the outer edges 22*c* and 22*d* are formed at respective locations inclined through a predetermined angle from the lowermost position.

A bottom 22*e* of the groove-shaped concave 22*b* is located at such a depth that the surface of the rotational shaft 21*a* of the feed rollers 21 does not contact the bottom 22*e* while the rotational shaft 21*a* of the feed rollers 21 is supported on the outer edges 22*c* and 22*d* of the groove-shaped concave 22*b*. Since the surface of the rotational shaft 21*a* of the feed rollers 21 does not contact the bottom 22*e* of the groove-shaped concave 22*b* of the bearing 22, frictional force is not caused between the surface of the rotational shaft 21*a* and the bottom 22*e* of the concave 22*b*. The bottom 22*e* of the groove-shaped concave 22*b* is substantially circular-arc and concentric with the circular inner surface 22*a* of the bearing 22 other than the groove-shaped concave 22*b*.

A gear (not shown) for transmitting driving force from a drive motor (not shown) is provided at the other end of the rotational shaft 21*a* of the feed rollers 21. As illustrated in FIGS. 5 and 6, pinch rollers 23 made of resin for pressing the paper 200 against the feed rollers 21 are equipped above the feed rollers 21. The pinch rollers 23 are attached to corresponding metal rotational shafts 23*a*. The rotational shafts 23*a* of the pinch rollers 23 are rotationally supported by corresponding holders 24 formed from resin. The holders 24 press the pinch rollers 23 against the feed rollers 21 by means of a spring (not shown).

As illustrated in FIG. 5, a base plate 25 made of resin is formed integral with the base cover 15 below the ink cartridges 20*a* and 20*b*. Discharge rollers 26 for discharging the paper 200 printed by the ink nozzles (not shown) of the ink cartridges 20*a* and 20*b* are provided adjacent to the base plate 25. A maintenance unit 27 for cleaning the ink nozzles (not shown) of the ink cartridges 20*a* and 20*b* is attached at the right side of the base plate 25 as viewed from the front.

The operation of the ink jet printer of the second embodiment is now described in conjunction with FIGS. 5 and 6. In operation of the ink jet printer of the second embodiment, the tip of the paper 200 (shown in FIG. 6) fed from the sheet feeding tray 17 (shown in FIG. 5) is inserted between the feed rollers 21 and the pinch rollers 23. The paper 200 thus inserted is pressed against the feed rollers 21 by the pinch rollers 23. In this condition, the feed rollers 21 are rotated to lead the paper 200 toward below the ink nozzles (not shown) of the ink cartridges 20*a* and 20*b* (shown in FIG. 5). When feeding of the paper 200 to this position is completed, the ink cartridges 20*a* and 20*b* which have been waiting above the maintenance unit 27 shift in the lateral direction. Then, printing by the ink nozzles (not shown) of the ink cartridges 20*a* and 20*b* starts.

When a line is printed on the paper 200 with lateral movement of the ink cartridges 20*a* and 20*b* along the shaft 18, the paper 200 is moved by a line in a direction shown by an arrow F in FIG. 6 by the rotation of the feed rollers 21. At this stage, the paper 200 applies a load to the feed rollers 21 in a direction opposite to the moving direction of the paper 200 (i.e., the direction of the arrow F in FIG. 6). After the paper 200 is moved by a line, another line starts to be printed on the paper 200 with lateral movement of the ink cartridges 20*a* and 20*b* (shown in FIG. 5). The above operation repeats until the whole printing on the paper 200 is completed.

In the ink jet printer of the second embodiment, shifting of the rotational shaft 21*a* of the feed rollers 21 along the inner surface 22*a* of the bearing 22 is prevented even when the load applied to the feed rollers 21 from the paper 200 is changed. As a result, variations in the feeding volume corresponding to a line of the paper 200 by the rotation of the feed rollers 21 are eliminated and uneven printing caused by the deviation from the printing positions is avoided. Then, the paper 200 thus printed is conveyed to the discharge rollers 26, and is finally discharged by the rotation of the discharge rollers 26.

The embodiments as described herein should be considered as only examples at all points and not at all limit any aspects of the present invention.

For example, the sheet feeder of the invention can be applied not only to the ink jet printer containing the same as in the second embodiment, but also to other apparatus, including various types of image forming units such as laser printers and sublimation-type thermal transfer printers.

Additionally, the bearing to be used in the sheet feeder of the present invention is not limited to that molded from resin as in the first and second embodiments, but other bearing formed from metal or other material may be employed. In this case, the pair of the outer edges of the groove-shaped concave of the bearing made of metal preferably do not have sharp tips but have beveled or round tips. When the outer edges are thus shaped, flaws or other damages given to the rotational shaft of the feed roller, which may be caused during rotation of the rotational shaft supported on the two outer edges of the groove-shaped concave, can be avoided.

Although the present invention has been shown and described with reference to a specific preferred embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. A sheet feeder comprising:

a feed roller for rotating around a rotational shaft and for feeding paper;

a bearing through which the feed roller is inserted leaving a predetermined width of play between the rotational shaft and the bearing for rotationally supporting the rotational shaft of the feed roller; and a pinch roller for pressing the paper against the feed roller, wherein:

a groove-shaped concave provided on an inner surface of the bearing extends therethrough in a direction where the rotational shaft of the feed roller extends;

a surface of the rotational shaft of the feed roller is supported on a pair of outer edges of the groove-shaped concave formed on the inner surface of the bearing; and a bottom of the groove-shaped concave is substantially circular-arc and concentric with a circular inner surface of the bearing other than the concave, and is formed at such a depth that the surface of the rotational shaft does not contact the bottom while the rotational shaft of the feed roller is supported on the two outer edges of the groove-shaped concave, wherein the pair of outer edges of the groove-shaped concave lie substantially on a circle defined by the circular inner surface of the bearing.

2. A sheet feeder comprising:

a feed roller for rotating around a rotational shaft and for feeding paper; and a bearing for rotationally supporting the rotational shaft of the feed roller, wherein:

the bearing includes a groove-shaped concave which is formed on an inner surface of the bearing and has a pair of outer edges for supporting a surface of the rotational shaft of the feed roller, wherein the pair of outer edges of the groove-shaped concave lie substantially on a circle defined by the inner surface of the bearing.

3. The sheet feeder according to claim 2, wherein a bottom of the groove-shaped concave of the bearing is formed at such a depth that the surface of the rotational shaft does not contact the bottom while the rotational shaft of the feed roller is supported on the two outer edges of the groove-shaped concave.

4. The sheet feeder according to claim 2, wherein a bottom of the groove-shaped concave of the bearing is a substantially circular-arc and concentric with a circular inner surface of the bearing other than the concave.

5. The sheet feeder according to claim 2, wherein a bottom of the groove-shaped concave of the bearing is formed flat.

6. A sheet feeder comprising:

a feed roller for rotating around a rotational shaft and for feeding paper;

a bearing through which the feed roller is inserted leaving a predetermined width of play between the rotational shaft and the bearing for rotationally supporting the rotational shaft of the feed roller; and a pinch roller for pressing the paper against the feed roller, wherein:

a groove-shaped concave provided on an inner surface of the bearing extends therethrough in a direction where the rotational shaft of the feed roller extends;

a surface of the rotational shaft of the feed roller is supported on a pair of outer edges of the groove-shaped concave formed on the inner surface of the bearing; and a bottom of the groove-shaped concave is substantially circular-arc and concentric with a circular inner surface of the bearing other than the concave, and is formed at such a depth that the surface of the rotational shaft does not contact the bottom while the rotational shaft of the feed roller is supported on the two outer edges of the groove-shaped concave, wherein a radius of the circular inner surface of the bearing is less than a radius of the substantially circular-arc of the groove-shaped concave.

* * * * *